US008397357B1

(12) United States Patent
Madey

(10) Patent No.: US 8,397,357 B1
(45) Date of Patent: Mar. 19, 2013

(54) SHOELACE RETAINING APPARATUS

(76) Inventor: John Madey, Jupiter, FL (US)

( * ) Notice: Subject to any disclaimer, the term of this patent is extended or adjusted under 35 U.S.C. 154(b) by 266 days.

(21) Appl. No.: 12/825,888

(22) Filed: Jun. 29, 2010

(51) Int. Cl.
*A43C 7/00* (2006.01)
*A43B 23/26* (2006.01)

(52) U.S. Cl. ..... 24/712.3; 24/306; 36/54; 36/136

(58) Field of Classification Search ..... 24/306, 24/712.1, 712.2, 712.5, 712.3; 36/50.1, 54, 36/136
See application file for complete search history.

(56) References Cited

U.S. PATENT DOCUMENTS

| | | | | |
|---|---|---|---|---|
| 4,571,854 | A * | 2/1986 | Edens | 36/50.1 |
| 4,949,437 | A | 8/1990 | Anderson | |
| 4,969,242 | A | 11/1990 | Carlton, Sr. | |
| 4,999,888 | A | 3/1991 | Miller | |
| 5,042,119 | A | 8/1991 | Williams | |
| 5,170,573 | A * | 12/1992 | Clinch | 36/50.1 |
| 5,572,774 | A * | 11/1996 | Duren | 24/306 |
| 5,778,500 | A * | 7/1998 | Illingworth | 24/712.3 |
| 5,918,352 | A | 7/1999 | Galbreath | |
| 6,684,543 | B2 * | 2/2004 | Fernau | 40/636 |
| 6,988,298 | B2 | 1/2006 | Ternasky et al. | |
| 7,003,903 | B2 | 2/2006 | Johnson | |
| 7,395,586 | B1 | 7/2008 | Gibson | |
| D664,348 | S * | 7/2012 | Armstrong | D2/978 |
| 2006/0168850 | A1 * | 8/2006 | Wartel et al. | 36/136 |
| 2009/0178257 | A1 | 7/2009 | Boone | |
| 2009/0293240 | A1 * | 12/2009 | Hubbard | 24/306 |
| 2012/0279088 | A1 * | 11/2012 | Cashel et al. | 36/136 |

* cited by examiner

*Primary Examiner* — Robert J Sandy
*Assistant Examiner* — Rowland D Do
(74) *Attorney, Agent, or Firm* — Gold & Rizvi, P.A.; Glenn E. Gold

(57) ABSTRACT

A retaining apparatus that is attached to a toe portion of a shoelace section of a laced shoe for securing loops and loose ends of a shoelace. The apparatus is fabricated of a substrate having an engagement surface and an external surface. The substrate is apportioned via a lateral midline into a fixed securing section and a free securing section. The fixed section includes a fastening configuration for securing the apparatus to the shoe. The fastening configuration can be an elongated tubular structure, a pair of loops, an attachment strap, or other fastening configuration. A first coupling interface portion is disposed upon the engagement surface of the fixed securing section and a mating coupling interface portion is disposed upon the engagement surface of the free securing section. The coupling interface engages the free section with the fixed section entrapping the loop and free ends of the shoelace.

2 Claims, 8 Drawing Sheets

SHOELACE RETAINING APPARATUS

FIELD OF THE INVENTION

The present disclosure generally relates to a shoelace retainer. More particularly, the present disclosure relates to a shoelace retaining apparatus that can be removably secured to a lace section proximate a shoe toe, using a clamping or gripping feature, for securing excess lengths (e.g., loops) of a tied shoelace.

BACKGROUND OF THE INVENTION

Footwear is provided in many form factors. Closed footwear takes into consideration the requirement to comfortably insert and remove one's foot from the upper. A moveable tongue aids in the insertion and removal of one's foot from the upper portion of the shoe. The width of the shoe proximate the tongue can be adjustable via elastic, a dense hook and loop interface, and more commonly a shoelace.

Shoelaces are commonly laced through a series of eyelets spacially arranged along each of two parallel sides of a tongue opening on an upper portion of the shoe. The shoelace draws the two parallel sides together to secure one's foot within the shoe. The shoelaces are tied in a bow at the heel end of the lace configuration. The loops are generally long and flop around when walking or running. If a free end of the lace gets snagged or stepped on, then pulled, the free end unravels the knot.

What is desired is a device to ensure that the free end of a shoelace remains stationary avoiding any unwarranted movement, which may result in unraveling of the shoelace knot.

SUMMARY OF THE INVENTION

The basic inventive concept provides a shoelace retaining apparatus, the apparatus is secured to a toe end of a laced shoelace and grips the loops and free ends of a knotted shoelace.

A first aspect of the present invention provides a shoelace retaining apparatus comprising:

an elongated base substrate having an engagement surface and an opposite external surface;

the elongated base substrate apportioned into a fixed section and a free section;

a tubular section integrated with the fixed section, wherein a hollow interior of the tubular section is arranged in a parallel relationship to an elongated surface of the fixed section;

a dense hook and loop patch coupling first surface disposed upon the engagement surface of the fixed section of the elongated base substrate; and a dense hook and loop patch coupling, mating surface disposed upon the engagement surface of the free section of the elongated base substrate.

A second aspect of the present invention incorporates a release tab at a distal end of the free section of the elongated base substrate.

In another aspect, the elongated base substrate is secured to a shoe via insertion of a substrate fastener through the tubular section hollow interior and continuing through a pair of opposite eyelets of the shoe.

In another aspect, the substrate fastener is a section of shoelace.

In another aspect, the substrate fastener is a cable tie, a ribbon, and the like.

In another aspect, the lace loops and free ends are positioned between the dense hook and loop patch coupling first surface and the dense hook and loop patch coupling, mating surface.

In another aspect, a toe lace loop aperture is provided through the tubular section allowing a toe lace loop to pass therethrough.

In another aspect, the tubular section is replaced by a pair of attachment straps, which secure the fixed section of the base substrate to a shoelace toe crossover section.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
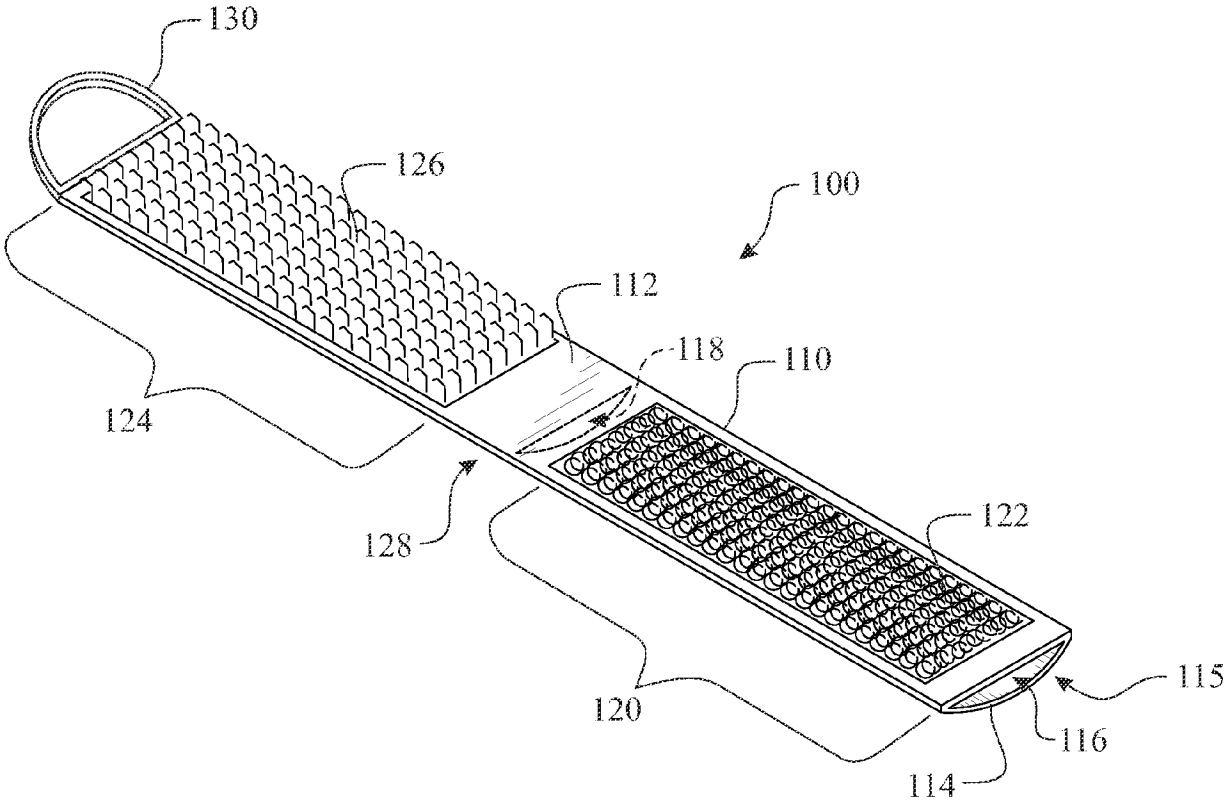
FIG. 1 presents an isometric view of a first exemplary embodiment of a shoelace retaining apparatus.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary embodiment, referred to as a shoelace loop holding device 100, is illustrated in FIGS. 1 through 6. The shoelace loop holding device 100 is fabricated having a base substrate 110 including a lace engagement interior surface 112 and an opposite external surface 114. The base substrate 110 can be fabricated of any reasonable material, including fabric, leather, denim, canvas, polyester, vinyl, ribbon, elastic, and the like. The shoelace loop holding device 100 includes a fixed lace securing section 120 and a free lace securing section 124. A base substrate fold 128 is created therebetween at a lateral centerline that apportions the fixed lace securing section 120 and the free lace securing section (see FIG. 4).

Figure 2:
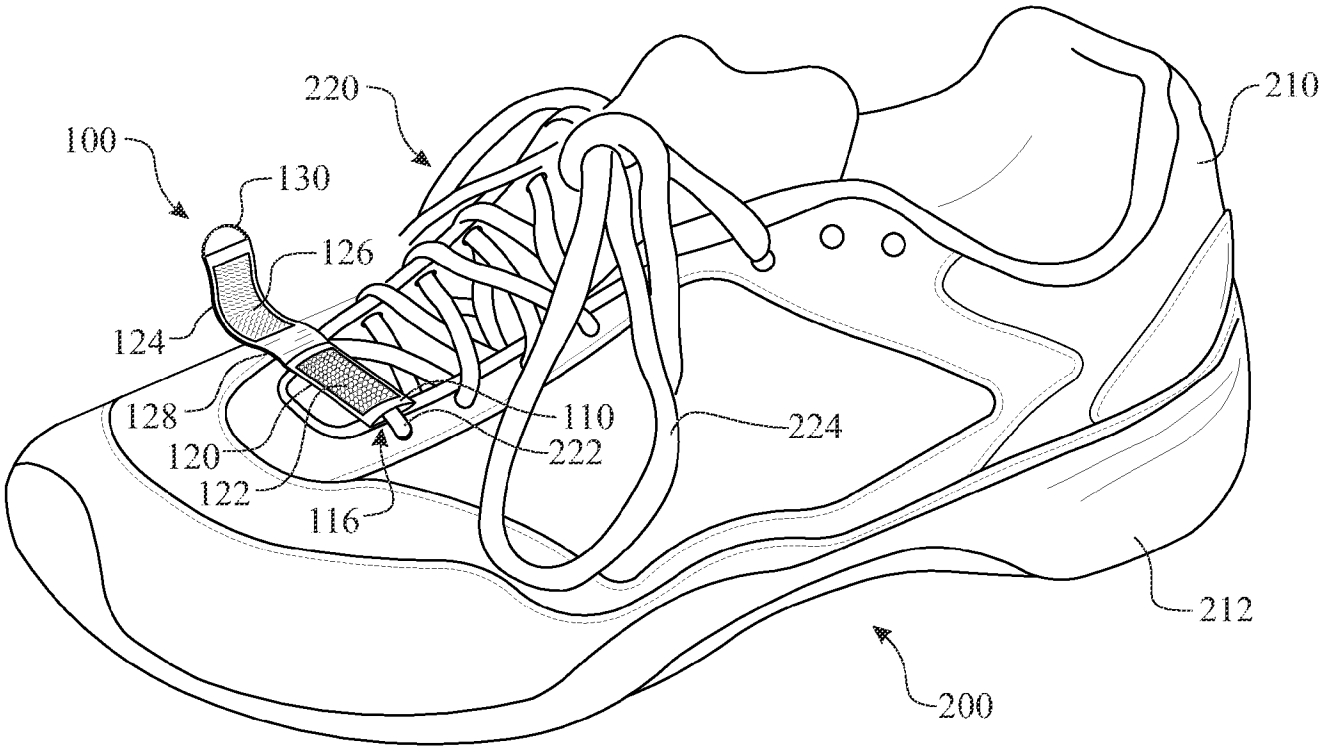
FIG. 2 presents an isometric view of the shoelace retaining apparatus of FIG. 1 illustrating an exemplary assembly process for securing the apparatus to a laced shoe.
Figure 3:
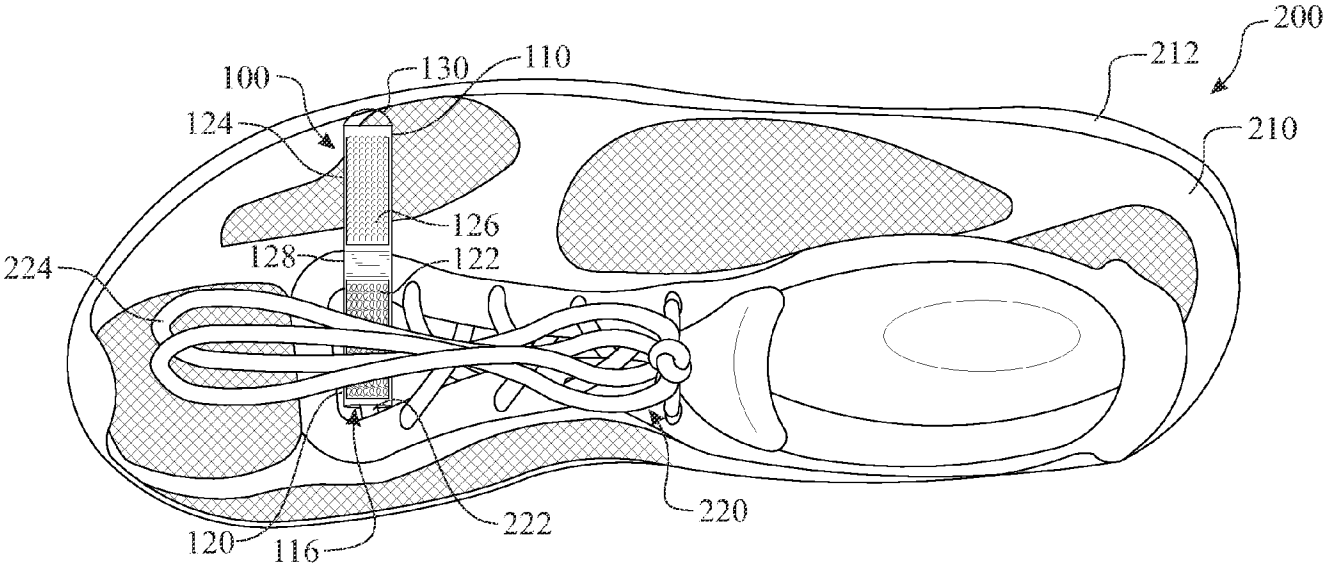
FIG. 3 presents a top view of the shoelace retaining apparatus assembled as configured in FIG. 2.
Figure 4:
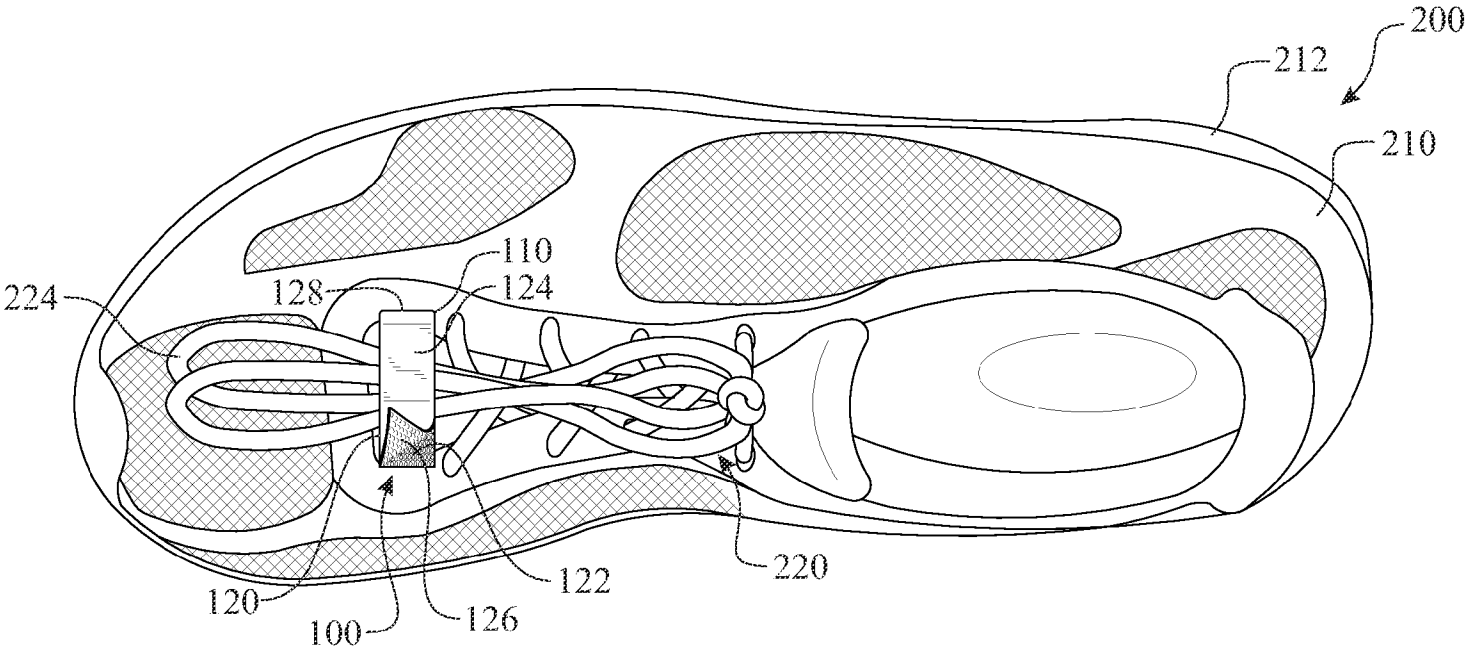
FIG. 4 presents a top view of the shoelace retaining apparatus in a shoelace retention configuration.
Figure 5:
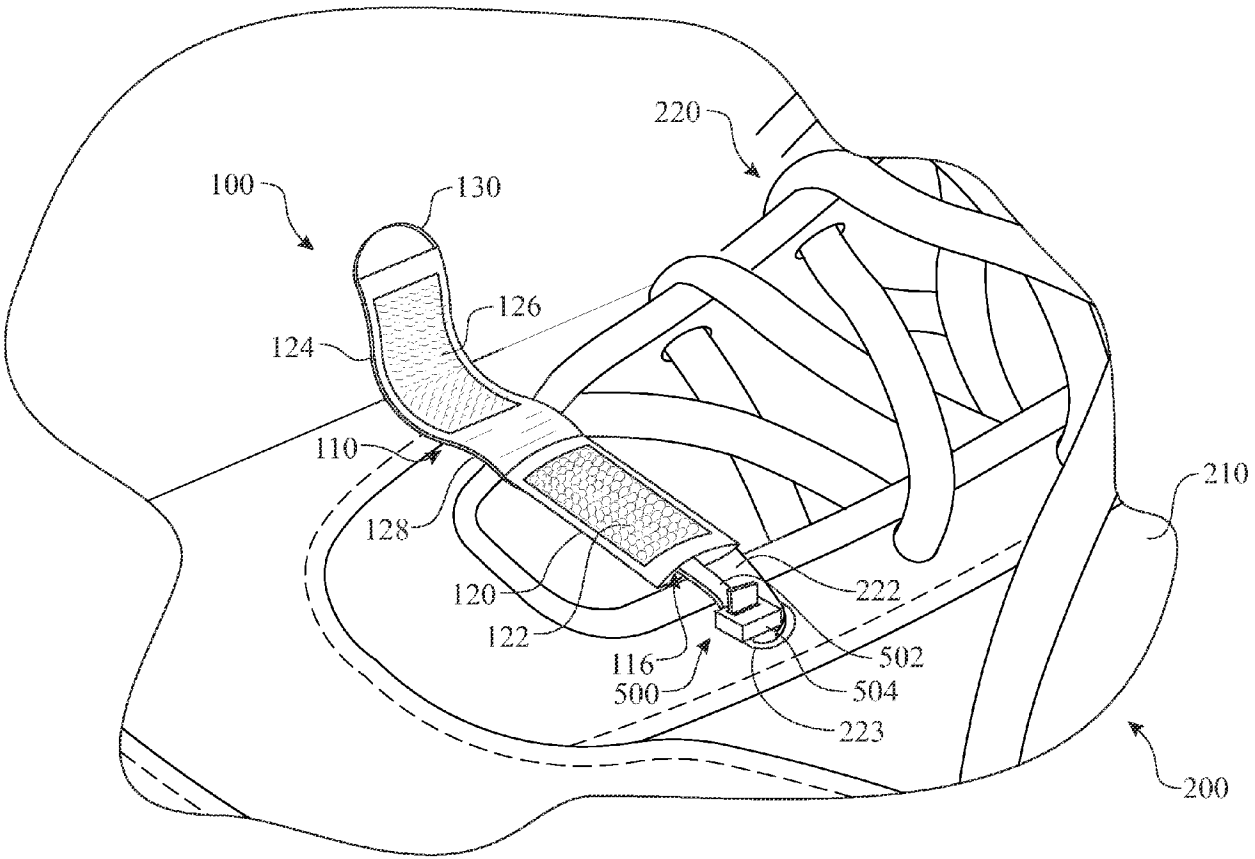
FIG. 5 presents an isometric view of the shoelace retaining apparatus of FIG. 1 illustrating an alternate exemplary assembly process for securing the apparatus to a laced shoe.

The fixed lace securing section 120 is secured to laced footwear 200 using any of a plurality of potential securing means. The laced footwear 200 comprises an upper 210, a sole 212, and a lace 220 that is laced through a series of eyelets 223 to aid in securing the laced footwear 200 onto a wearer's foot. The shoelace loop holding device 100 includes a shoe coupling interface integrated with the fixed lace securing section 120. One embodiment of the shoe coupling interface is a tubular region 115 having a distal fastening aperture 116 located proximate a distal end of the fixed lace securing section 120, and a central fastening aperture 118 located proximate a fold end of the fixed lace securing section 120. A fastening member is inserted through a hollow interior of the tubular section 115 and secured to an eyelet 223 as illustrated in FIG. 5. One exemplary fastening member is a lower lace loop length 222 of a lace 220, as illustrated in FIGS. 2 through 4. This requires at least partial removal of the lace 220 from the laced footwear 200 in order to thread the lace 222 through the tubular region 115. A second exemplary fastening member is a cable tie 500, as illustrated in FIG. 5. The cable tie 500 is fabricated having a cable tie latch 504 formed at one end of a cable tie strap 502. The cable tie strap 502 is threaded through the tubular region 115 and each of a pair of eyelets 223. The cable tie strap 502 is then inserted into the cable tie latch 504 and pulled tight, attaching the shoelace loop holding device 100 to the laced footwear 200. This avoids the requirement to at least partially remove the lace 220 from the laced footwear 200.

A loop portion 122 of a hook-and-loop fastening system defines a first coupling interface. The loop portion 122 is disposed upon the engagement surface 112 within the fixed lace securing section 120. A corresponding hook portion 126 of a hook-and-loop fastening system defines a mating coupling interface. The hook portion 126 is disposed upon the engagement surface 112 within the free lace securing section 124. The loop and hook portions, 122 and 126, respectively, are attached to engagement surface 112 via an adhesive, stitching, heat staking, and any other known method. As will be apparent to those skilled in the art, the positioning of the loop and hook portions can be switched without affecting the efficacy of the invention. In use, the user places a free end of the lace 220 and a lace tie loop 224 onto the fixed lace securing section 120 as illustrated in FIG. 3, then rotates the free lace securing section (or flap) 124 about the substrate fold 128, such that the free section 124 is above the fixed section 120. As best shown in FIG. 4, in this manner, areas of the loop and hook portions, 122 and 126, engage each other fixedly trapping the lace loop 224 and the free end of the lace 220 therebetween such that the lace loop 224 and the free end of the lace 220 are generally parallel to the longitudinal axis of a tongue of the laced footwear 200. Significantly, in many instances, hook portion 126 will independently attach to the lace material to further secure the lace loop. A release tab 130 can be integrated into the shoelace loop holding device 100, extending from the distal end of free lace securing section 124. The release tab 130 acts as a gripping aid to assist with separating the free lace securing section 124 from the fixed lace securing section 120.

Figure 6:
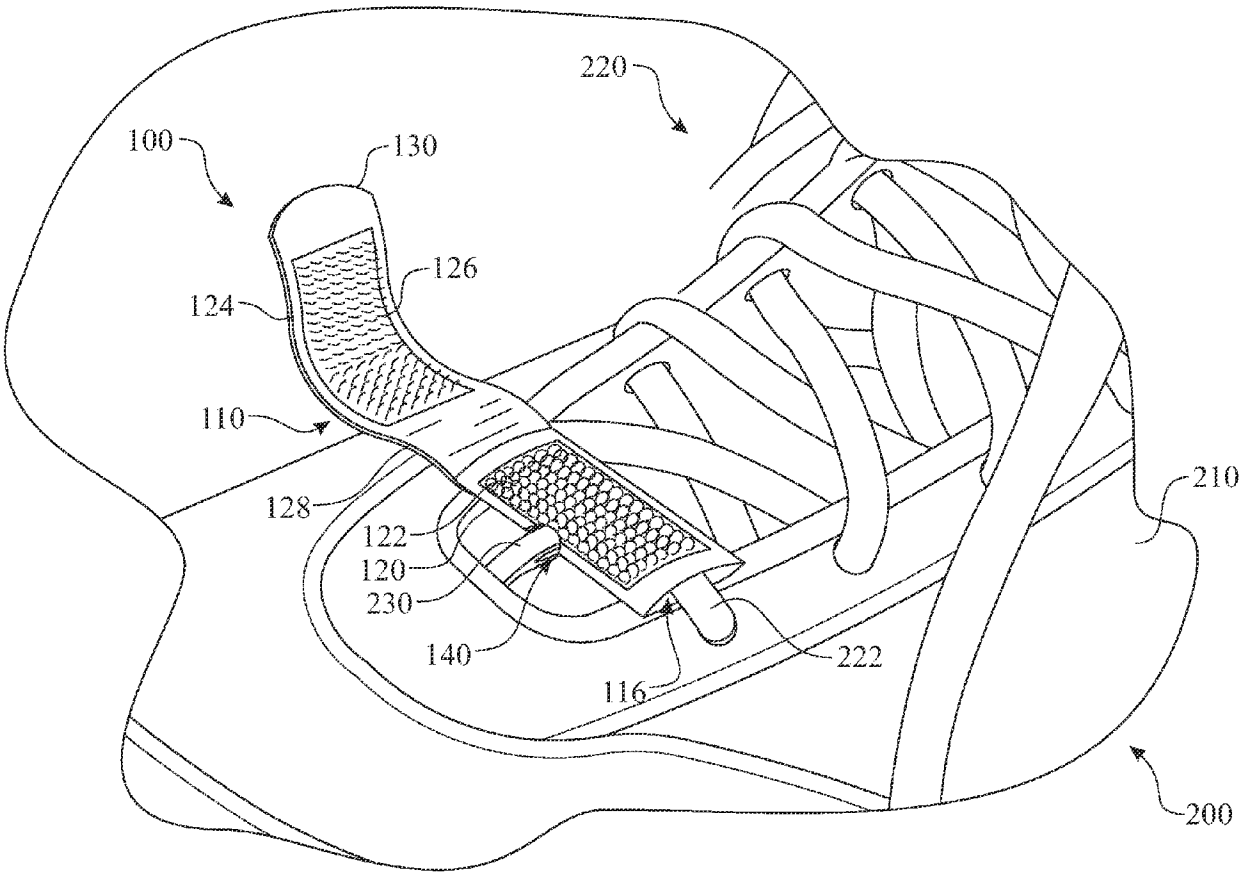
FIG. 6 presents an isometric view of a modified version of the shoelace retaining apparatus of FIG. 1, modified to accommodate a lower lace loop.

Referring particularly to FIG. 6, laced footwear 200 may include a toe lace support loop 230, usually located proximate a toe end of the lacing. Accordingly, in an exemplary embodiment of the invention, the shoelace loop holding device 100 is designed to accommodate this structure. For instance, a lace loop opening 140 can be provided extending through fixed lace securing section 120 to enable insertion of toe lace support loop 230 into the interior space of the securing section. With support loop 230 inserted into section 120 as just described, the lower lace loop length 222 is threaded through the toe lace support loop 230. The lace loop aperture 140 can be of any reasonable shape to accommodate the toe lace support loop 230.

Figure 7:
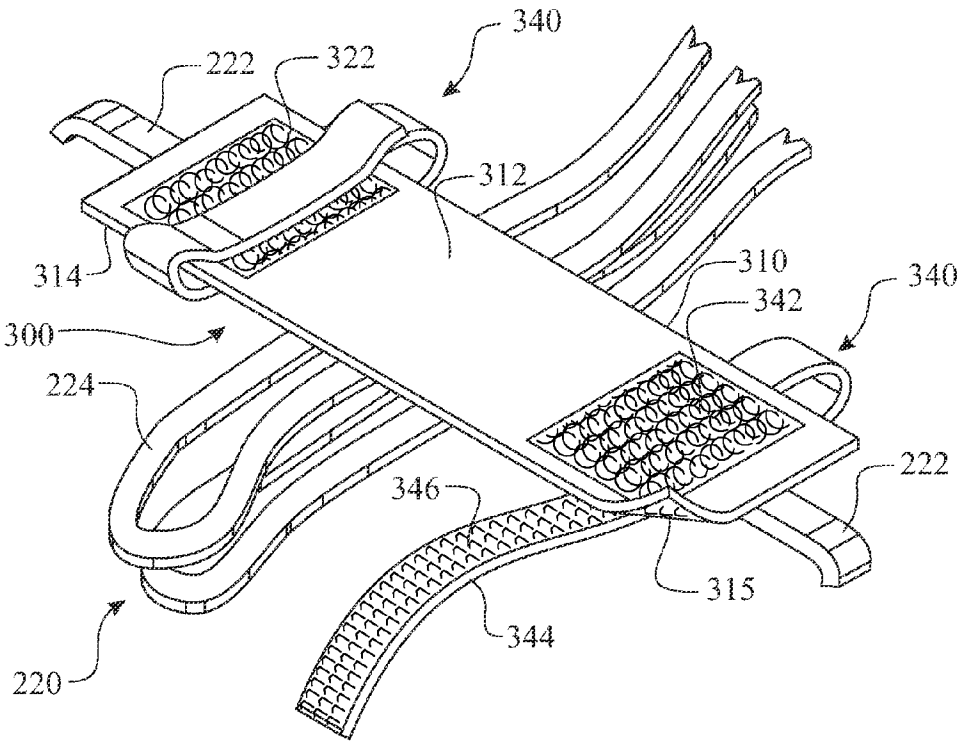
FIG. 7 presents an isometric view of a second exemplary embodiment of a shoelace retaining apparatus.

It is understood that the tubular section 115 could be considered a limiting element of the present invention. The tubular section 115 dictates that an object is threaded therethrough for attaching the shoelace loop holding device 100 to the laced footwear 200. Referring now to FIG. 7, a second exemplary embodiment, referred to as shoelace loop holding device 300, provides an alternate attachment mechanism. The shoelace loop holding device 300 is fabricated having a base substrate 310. A pair of spaced apart attachment straps 320 extends generally perpendicular from an elongated edge of the base substrate 310. A dense hook and loop patch coupling mating surface 346 is provided upon a surface of a fastening tape 344, forming the attachment straps 340. A dense hook and loop patch coupling first surface 342 is attached to upper surface 312 of the base substrate 310 for mating attachment with respective dense hook and loop patch coupling mating surface 346.

In use, lace tie loops 224 are placed over the lower lace loop length 222. The lace holder base substrate 310 is placed over the lace tie loop 224 and lower lace loop length 222. Each attachment strap 340 is extended below lower lace loop length 222 and wrapped around fastening the dense hook and loop patch coupling mating surface 346 to the respective dense hook and loop patch coupling first surface 342. A dense hook lace engaging surface 315 is preferably provided upon a lower surface 314 of the base substrate 310. The dense hook lace engaging surface 315 grips the lace tie loop 224 to aid in maintaining the lace tie loop 224 in position.

Figure 8:
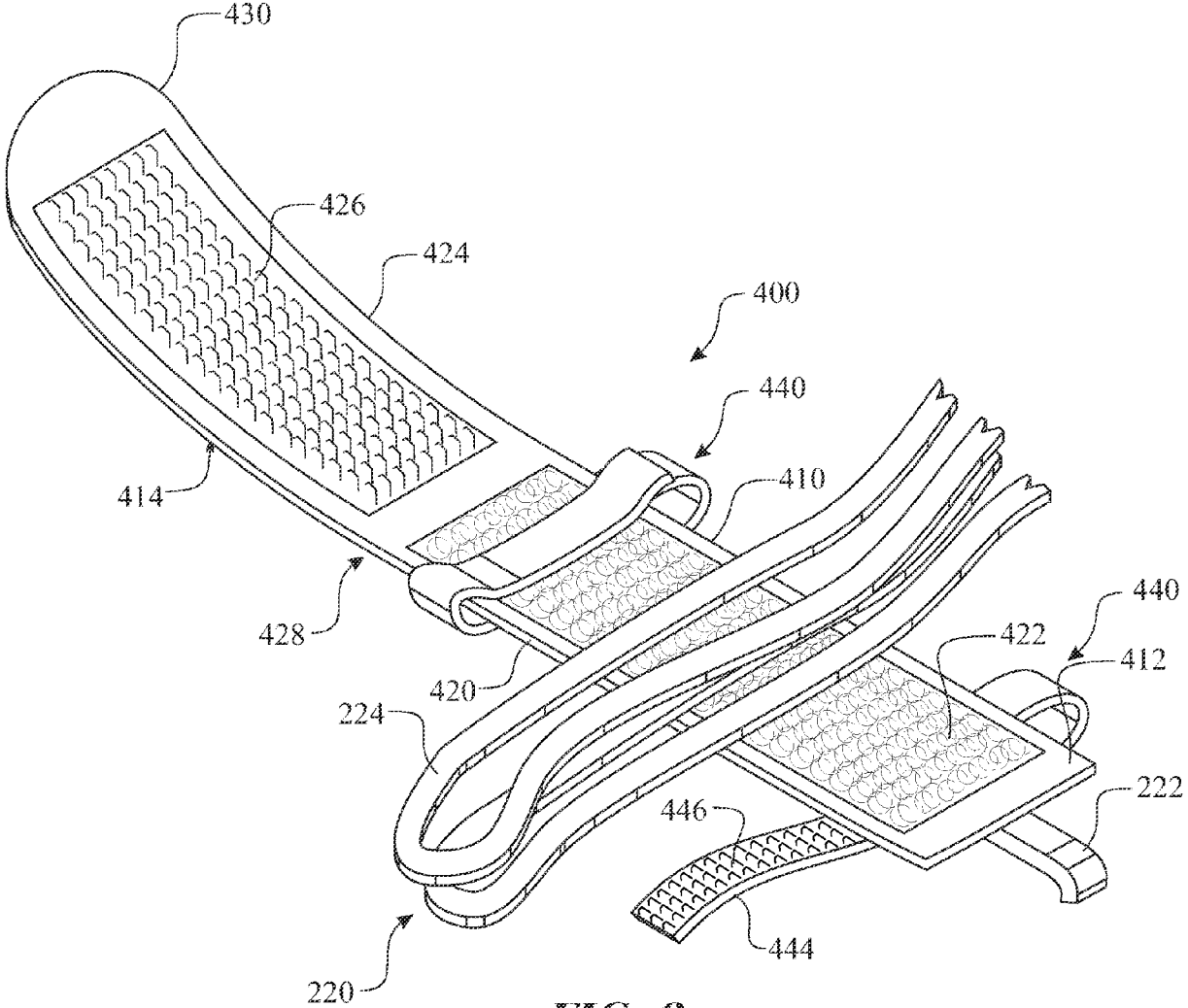
FIG. 8 presents an isometric view of a third exemplary embodiment of a shoelace retaining apparatus.

A third exemplary embodiment, referred to as shoelace loop holding device 400, illustrated in FIG. 8, utilizes the alternate attachment interface of the shoelace loop holding device 300 and the shoelace securing configuration of the shoelace loop holding device 100. The shoelace loop holding device 400 is fabricated having a base substrate 410. Like shoelace loop holding device 100, base substrate 410 is constructed having an upper surface 412 and a lower surface 414. The base substrate 410 is segmented into a fixed lace securing section 420 and a free lace securing section 424, creating a substrate fold 428 therebetween. A dense hook and loop patch coupling mating surface 426 is disposed upon the upper surface 412 of the free lace securing section 424. Similarly, a dense hook and loop patch coupling first surface 422 is attached to an upper surface 412 of the base substrate 410. A pair of spaced-apart attachment straps 440 extends generally perpendicular from an elongated edge of the fixed lace securing section 420 of the base substrate 410. A dense hook and loop patch coupling mating surface 446 is provided upon a surface of a fastening tape 444, forming the attachment straps 440.

In use, base substrate 410 is placed over the lower lace loop length 222. Then, each attachment strap 440 is extended beneath the lower lace loop length 222 and wrapped around to the upper surface 412 of the base substrate 410, engaging the dense hook and loop patch coupling mating surface 446 with the dense hook and loop patch coupling first surface 422. The lace tie loops 224 are then placed atop the upper surface 412 between the pair of attachment strap 440. The free lace securing section 424 is folded over along the substrate fold 428 and secured to the fixed lace securing section 420, entrapping the lace tie loop 224. A fixed lace securing section 420 is configured, extending from an unattached end of the free lace securing section 424, proving the wearer with an aid for separating the free lace securing section 424 from the fixed lace securing section 420. A release tab 430 extends from a distal (free) end of the free lace securing section 424, aiding in separation of the dense hook and loop patch coupling mating surface 426 from the dense hook and loop patch coupling first surface 422.

Although several embodiments are presented for attaching the shoelace loop holding device 100, 300, 400 to the 200, it is understood that any attachment interface can be used. Similarly, the preferred coupling interface utilizes a dense hook and loop material, it is understood that any coupling interface which would secure the lace tie loop 224 therebetween can be utilized. The exemplary embodiments illustrate the shoelace loop holding device 100, 300, 400 as being attached to the lower lace loop 222 or the eyelet 223 closest to the toe, it is understood that the loop holding device 100, 300, 400 can be assembled to any section of lace between a pair of eyelets or directly to any pair of eyelets along the lacing section of the laced footwear 200.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A shoelace retaining apparatus comprising:

an elongated base substrate having an engagement surface and an opposite external surface;

the elongated base substrate apportioned via a lateral centerline into a fixed section and a free section;

a shoe coupling interface integrated into the fixed section, wherein the shoe coupling interface comprises a tubular structure integrated into the fixed section, the tubular structure including a distal fastening aperture located proximate a distal end of the fixed section, and a central fastening aperture located proximate a fold end of the fixed section, wherein the tubular structure is oriented parallel to a longitudinal axis of the base substrate;

a first coupling interface portion disposed upon the engagement surface of the fixed section of the elongated base substrate; and a mating coupling interface portion disposed upon the engagement surface of the free section of the elongated base substrate, wherein the shoelace retaining apparatus is removably attached to a laced shoe via the shoe coupling interface, wherein a loop portion and a free end portion of the shoelace are entrapped between the engagement surface of the fixed section and the engagement surface of the free section by mating the first coupling interface portion and the mating coupling interface portion, wherein the entrapment directs the lace loop and the free end of the lace to be generally parallel to a longitudinal axis of a tongue of the laced shoe, and wherein the first coupling interface portion comprises one of a group of a dense hook surface and a dense loop surface and the mating coupling interface portion comprises a mating surface, wherein the mating surface of the dense hook surface is the dense loop surface and the mating surface of the dense loop surface is the dense hook surface.

2. A shoelace retaining apparatus as recited in claim 1, the apparatus further comprising a release tab extending from a distal end of the free section.

* * * * *